US007788809B2

(12) United States Patent
Tomassetti

(10) Patent No.: US 7,788,809 B2
(45) **Date of Patent: *Sep. 7, 2010**

(54) DISPOSABLE RAZOR WITH INTEGRATED SHAVING CREAM DISPENSER

(76) Inventor: Louis D. Tomassetti, 2745 E. Atlantic Blvd., Suite #300, Pompano Beach, FL (US) 33062

( * ) Notice: Subject to any disclaimer, the term of this patent is extended or adjusted under 35 U.S.C. 154(b) by 224 days.

This patent is subject to a terminal disclaimer.

(21) Appl. No.: 11/985,683

(22) Filed: Nov. 16, 2007

(65) Prior Publication Data

US 2009/0126197 A1 May 21, 2009

(51) Int. Cl.
*B26B 21/44* (2006.01)

(52) U.S. Cl. ..... 30/41; 30/535; 222/402.13

(58) Field of Classification Search ..... 30/41, 30/535; 222/402.11, 402.13
See application file for complete search history.

(56) References Cited

U.S. PATENT DOCUMENTS 4,791,723 A * 12/1988 Jacobson ..... 30/41
4,813,138 A * 3/1989 Chen ..... 30/41
4,908,945 A * 3/1990 Jacobson ..... 30/41
5,016,351 A * 5/1991 Drahus ..... 30/41
5,070,611 A * 12/1991 Derin et al. ..... 30/41
5,092,041 A * 3/1992 Podolsky ..... 30/41
5,287,624 A * 2/1994 Mondo et al. ..... 30/41
5,368,473 A * 11/1994 Kenjiro et al. ..... 431/153
5,655,302 A * 8/1997 Mroczka ..... 30/41
5,701,674 A * 12/1997 Mitchell ..... 30/41
5,855,066 A * 1/1999 Manger ..... 30/41
6,588,631 B2 * 7/2003 Sanchez ..... 222/402.13
7,051,439 B2 * 5/2006 Tomassetti ..... 30/41
2008/0173835 A1 * 7/2008 Tomassetti ..... 251/118
2009/0235530 A1 * 9/2009 Tomassetti ..... 30/41.5

* cited by examiner

*Primary Examiner*—Hwei-Siu C Payer
(74) *Attorney, Agent, or Firm*—Robert M. Downey, P.A.

(57) ABSTRACT

A disposable safety razor having an integral shaving conditioner dispenser includes a neck to which a blade cartridge is affixed at a top end thereof and a handle extends downwardly therefrom. The handle is ergonomically shaped and has an exterior wall that defines a pressure cavity therein for receiving a shaving conditioning compound and a pressurized dispensing gas. The handle has an opening at its bottom and a valve received in the opening. The valve is configured to dispense the shaving conditioning compound downwardly through the valve with the razor held upright. A dispensing cap covers the valve and is engaged therewith such that movement of the dispensing cap causes release of the shaving conditioning compound downwardly through the valve and out from a discharge opening in the cap while holding the razor upright with the blade cartridge and neck positioned higher than the handle bottom and dispensing cap.

16 Claims, 3 Drawing Sheets

DISPOSABLE RAZOR WITH INTEGRATED SHAVING CREAM DISPENSER

BACKGROUND OF THE INVENTION

1. Field of the Invention

The present invention relates to safety razors and, more particularly, to safety razors that dispense a shave product such as shave cream, gel or lotion.

2. Discussion of the Related Art

In the late eighteenth century a Frenchman, Jean-Jacques Perret, invented the safety razor. A safety razor protects the skin of the person being shaved from all but the very edge of the blade. Subsequent to Perret's invention, the first safety razor with disposable blades was released in the U.S. in the early 20th century. Shaving has now been primarily transformed into a personal hygiene activity utilizing safety razors that are either totally or partially disposable.

Evolution of the safety razor has now progressed such that they now have one or more parallel blades that are encapsulated in a molded cartridge. This molded cartridge presents the blades at an optimum angle to closely remove the desired whiskers or hair, while leaving the skin smooth and uncut. The cartridge may be permanently affixed to a disposable handle such that the entire razor, handle and blade cartridge is discarded once the blades become dull. Alternatively, a disposable cartridge is removably attached to a reusable handle, wherein only the cartridge is discarded when the blades become dull and is then replaced with a new cartridge. As discovered with those first safety razors, the user's skin and whiskers must be moistened and lubricated prior to shaving in order to obtain a close, smooth shave with minimal cuts and irritation to the skin. Thus, the process of wet shaving (i.e. using a safety razor in combination with water and a shaving cream or gel to moisturize and lubricate the skin surface) has become commonplace.

Today's society is increasingly mobile and many times a person has a need for carrying personal hygiene items to different locations. This need might manifest itself in a short trip to the local gym or on a longer business trip. In these instances, the traveler must often carry an entire personal care kit that becomes bulky with many personal hygiene items. Carrying both a razor and a pressurized container of shave cream can be inconvenient. Moreover, current airline travel restrictions imposed by the Transportation Safety Administration (TSA) limit the size of containers that can be packed in carry-on luggage, specifically containers holding liquids, gels, creams and paste are limited in size to 3 ounces or less when carried by the passenger on the aircraft. Thus, smaller containers (3 ounces or less) for shaving creams, lotions and gels are much more desirable for travel.

Most shave cream and gel products are packaged in an aluminum can, under pressure, along with a propellant agent to promote discharge upon operation of a valve button. As noted above, the need to carry a separate container of shave cream is inconvenient when traveling, especially on commercial airlines. Additional problems associated with metal shave cream containers include the inconvenience of having to handle two separate items (i.e., a razor and a shave cream dispensing container) when shaving, as well as the added space needed in one's medicine cabinet to place both the razor and shave cream container. And, because the metal shave cream can is constantly exposed to water and moisture when shaving, the metal can eventually begins to rust. This results in the shaving cream can leaving unsightly rust stains (i.e. rings) on the vanity counter surface and/or shelves in the medicine cabinet.

One safety razor that attempts to alleviate the problems of a separate shave cream container provides an integrated shaving cream dispenser in its handle. However, in order to use the handle dispenser, the razor must be inverted, whereupon the shaving cream is dispensed into the user's opposite hand with the blade cartridge facing down and the blades close to the hand that is holding the razor. The razor must then be turned upright in the user's hand in order to shave. Such a procedure can be awkward and clumsy, especially when the user's hands are wet and covered with shave cream.

Ideally, what is desired is a readily accessible, convenient, and ergonomic shave product containment system integrated with a safety razor that can dispense the shave product downwardly from the lower end of the razor handle when the razor is held in the normal upright shaving position.

SUMMARY OF THE INVENTION

The present invention is directed to a disposable safety razor with a shaving conditioning compound (e.g., shave cream or shave gel) stored in the razor handle that satisfies the need to minimize the bulk of storing a can of shaving cream in areas having limited storage space. The disposable safety razor includes a neck to which a blade cartridge is affixed at a top end thereof. A handle from a bottom end of the neck and has an exterior wall that defines a pressure cavity for receiving a shaving conditioning compound and a pressurized dispensing gas. The handle has an opening at its bottom and a valve received in the opening. The valve is configured to dispense the shaving conditioning compound downwardly through the valve with the razor held upright (i.e., with the neck and blade cartridge held higher than the bottom end of the handle.) A dispensing cap covers the valve and is engaged therewith such that movement of the dispensing cap causes release of the shaving conditioning compound downwardly through the valve and out from an opening in the dispensing cap. The dispensing cap may include a locking mechanism to prevent accidental dispensing of the shaving conditioning compound.

Another aspect of the present invention is a disposable safety razor having an integral shaving conditioner dispenser that includes a neck and a blade cartridge affixed to a top end of the neck. A handle ergonomically shaped to fit the inner contour of a human hand extends from a bottom end of the neck. The handle has an exterior wall that defines a pressure cavity therein for receiving a shaving conditioning compound and a pressurized dispensing gas. The handle further defines an opening at a bottom thereof that receives a valve therein. The opening is configured to dispense the shaving conditioning compound downwardly through the valve. A dispensing cap covers the valve and is engaged therewith such that movement of the dispensing cap causes release of the shaving conditioning compound downwardly through the valve and out from a discharge opening in the cap. An actuator is affixed to a side of the handle and a transfer mechanism interconnects the actuator with the dispenser cap. This may be conveniently accomplished by pressing the bottom end of the handle (i.e., the dispensing cap) against the palm of the user's hand, or other surface, wherein an upward force of the dispensing cap against the valve serves to open the valve and release the shaving conditioning compound.

Other aspects of the present invention include configuring the actuator as either a slidable button or as a pivotable lever. The transfer mechanism can be configured as a flexible ribbon slidably housed in a channel defined in the handle wall, wherein a first end of the ribbon is affixed to the actuator and a second end of the ribbon is affixed to the dispenser cap. Further, the dispenser cap can be configured to dispense the shaving conditioning compound either directly downward through a port at the bottom apex of the cap or radially from the side of the cap.

These and other features, aspects, and advantages of the invention will be further understood and appreciated by those skilled in the art by reference to the following written specification, claims and appended drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 1:
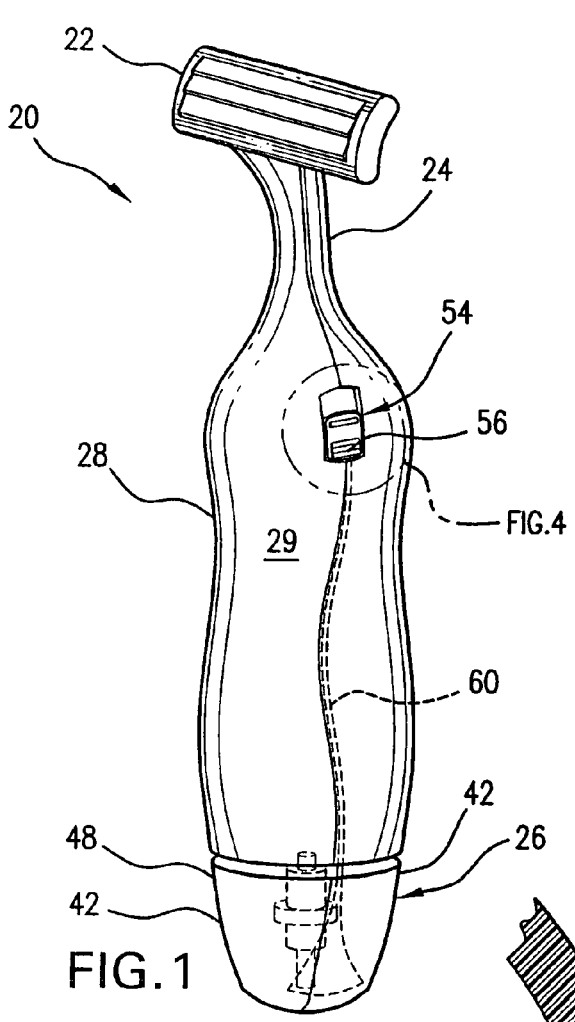
FIG. 1 is a perspective view of a disposable safety razor embodying the present invention, wherein the handle of the safety razor also functions as a shaving cream dispenser.
Figure 2:
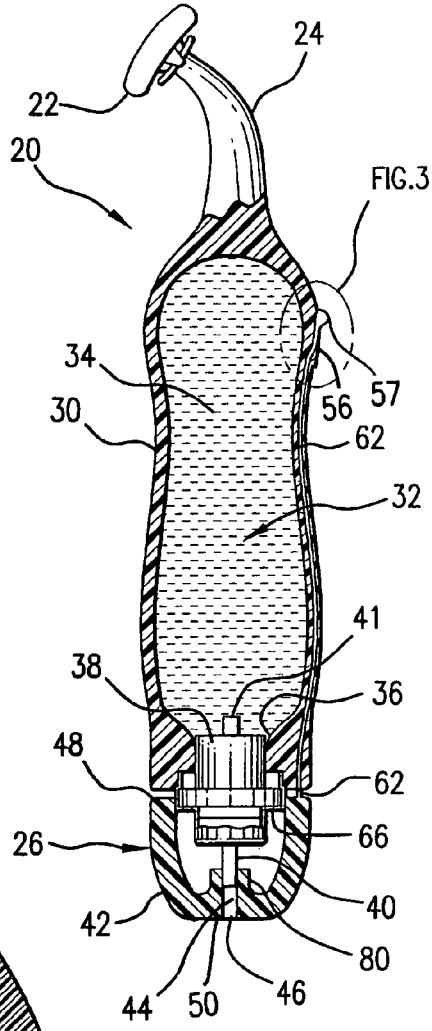
FIG. 2 is a elevational cross-section view of the dispenser handle of the safety razor of FIG. 1.

For purposes of description herein, the terms "upper", "lower", "left", "rear", "right", "front", "vertical", "horizontal", and derivatives thereof shall relate to the invention as oriented in FIG. 1. However, one will understand that the invention may assume various alternative orientations and step sequences, except where expressly specified to the contrary. While the present invention has been shown and described in accordance with preferred and practical embodiments thereof, one will also recognize that departures from the instant disclosure are fully contemplated within the spirit and scope of the invention. Hence, specific dimensions and other physical characteristics relating to the embodiments disclosed herein are not to be considered as limiting, unless the claims expressly state otherwise.

Turning to the drawings, FIG. 1 shows a disposable safety razor 20 including an integral dispenser 26 which is one of the preferred embodiments of the present invention and illustrates its various components. The dispenser 26 is used for dispensing a shaving conditioning compound 34, such as shaving cream, shaving gel, or a shaving lotion.

The construction of a first embodiment of disposable razor 20 is illustrated in FIGS. 1-4. Since safety razor 20 is typically disposable, razor 20 has a blade cartridge 22 pivotally affixed to a neck 24 at a top portion thereof. A handle 28 extends from a bottom of neck 24 to form an integral unit. Handle 28 has an outer form factor 29 that is ergonomically shaped overall size compared to a conventional razor handle and is preferably formed of a moldable resin, such as plastic. Handle 28 has a wall structure 30 that surrounds a hollow interior defining a pressure cavity 32. Pressure cavity 32 is within the portion of handle 28 that contains the shaving conditioning compound 34 combined with a volume of pressurized gas for forcing the compound 34 out of dispenser 26 during use.

Handle 28 has a bottom opening 36 within which is received a valve 38. Valve 38 is secured within opening 36 with a crimped metal cap 66 that withstands the pressure of the contents in cavity 32. Valve 38 is of a type well known in the art, wherein a hollow valve stem 40 extends through valve 38 and further has a portion that extends downwardly from valve 38. Valve 38 normally functions to maintain valve stem 40 in a closed state, such that fluid and gas cannot pass therethrough, and further seals the pressurized contents of cavity 32 within handle 28. When valve stem 40 is either laterally or axially displaced, valve 38 is opened to allow fluids such as shaving conditioning compound 34 to pass through valve stem 40 and out therefrom. An upper valve stem portion 41 extends minimally into cavity 32 for directing compound 34 through valve 38 and into valve stem 40 when valve 38 is open. The minimal protrusion of portion 41 facilitates the upright usage of dispenser 26 to collect the maximum amount of compound 34 at the bottom of cavity 32 as the cavity nears depletion of compound 34.

A dispenser cap 42 covers valve 38. An upper edge 48 of cap 42 registers proximately with the bottom portion of handle 28. A dispensing duct 44 extends through the bottom apex 50 of cap 42 and is sleeved over valve stem 40 of valve 38 in an interfering manner to retain cap 42 on dispenser 26. Lateral or vertical movement of dispenser cap 42 results in a similar movement of valve stem 40 such that movement of dispenser cap 42 will cause valve 38 at 80 to open and provide fluidic communication between cavity 32 and dispensing duct 44. Dispensing duct 44 directs the released compound 34 from hollow valve stem 40 to exit dispenser 26 through dispenser port 46 into a user's hand.

Figure 4:
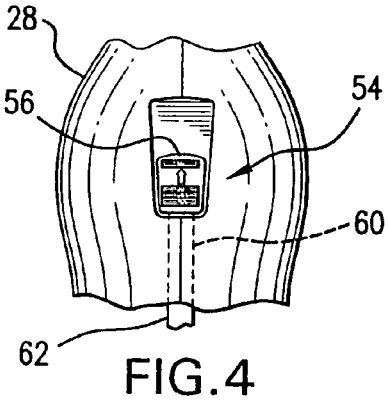
FIG. 4 is an enlarged view of the actuator area of FIG. 1 and denoted by line 4, FIG. 1.
Figure 3:
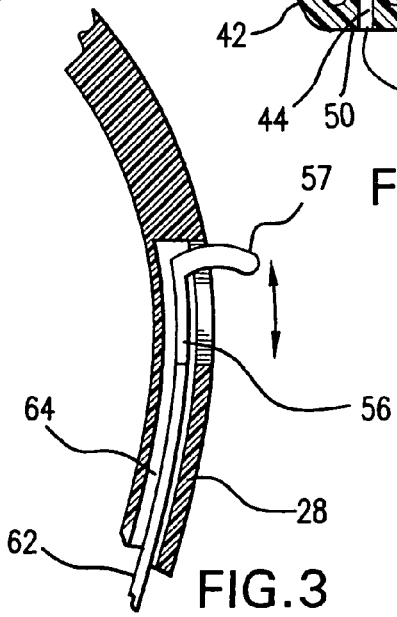
FIG. 3 is an enlarged cross-sectional view of the finger actuator area shown in FIG. 2 and denoted by line 3, FIG. 2.

As best illustrated in FIGS. 3 and 4, an actuator 54 is positioned proximate to the top of handle 28 and is interconnected to dispensing cap 42 with a transfer mechanism 60. Referring to FIGS. 1, 3, and 4, actuator 54 is a slidable button 56 that includes at least one protrusion 57 to facilitate tactile feedback when touched by a user's finger. In such a manner, the user can locate button 56 by feel without need to visibly see button 56. Protrusion 57 also provides a surface for the user's finger to push against when attempting to slide button 56. Transfer mechanism 60 comprises a flexible ribbon 62 typically fabricated from a semi-rigid plastic and is slidably housed in a channel 64 formed in exterior wall 30 of handle 28. Flexible ribbon 62 has an upper end attached to slidable button 56 and a bottom end affixed to upper edge 48 of dispenser cap 42. When slidable button 56 is translated, ribbon 62 is translated in like manner and by reason of its attachment to upper edge 48 of dispenser cap 42, dispenser cap is caused to move either laterally or vertically, thereby causing shaving conditioning compound 34 to be released through valve 38. The dispenser cap may be structured to include a locking feature to prevent unwanted dispensing of the shaving conditioning compound between use, such as when the razor is carried in a travel bag or suitcase. Those practiced in the art will readily recognize that other actuator configurations known in the art can be readily used in place of slidable button 56.

Figure 5:
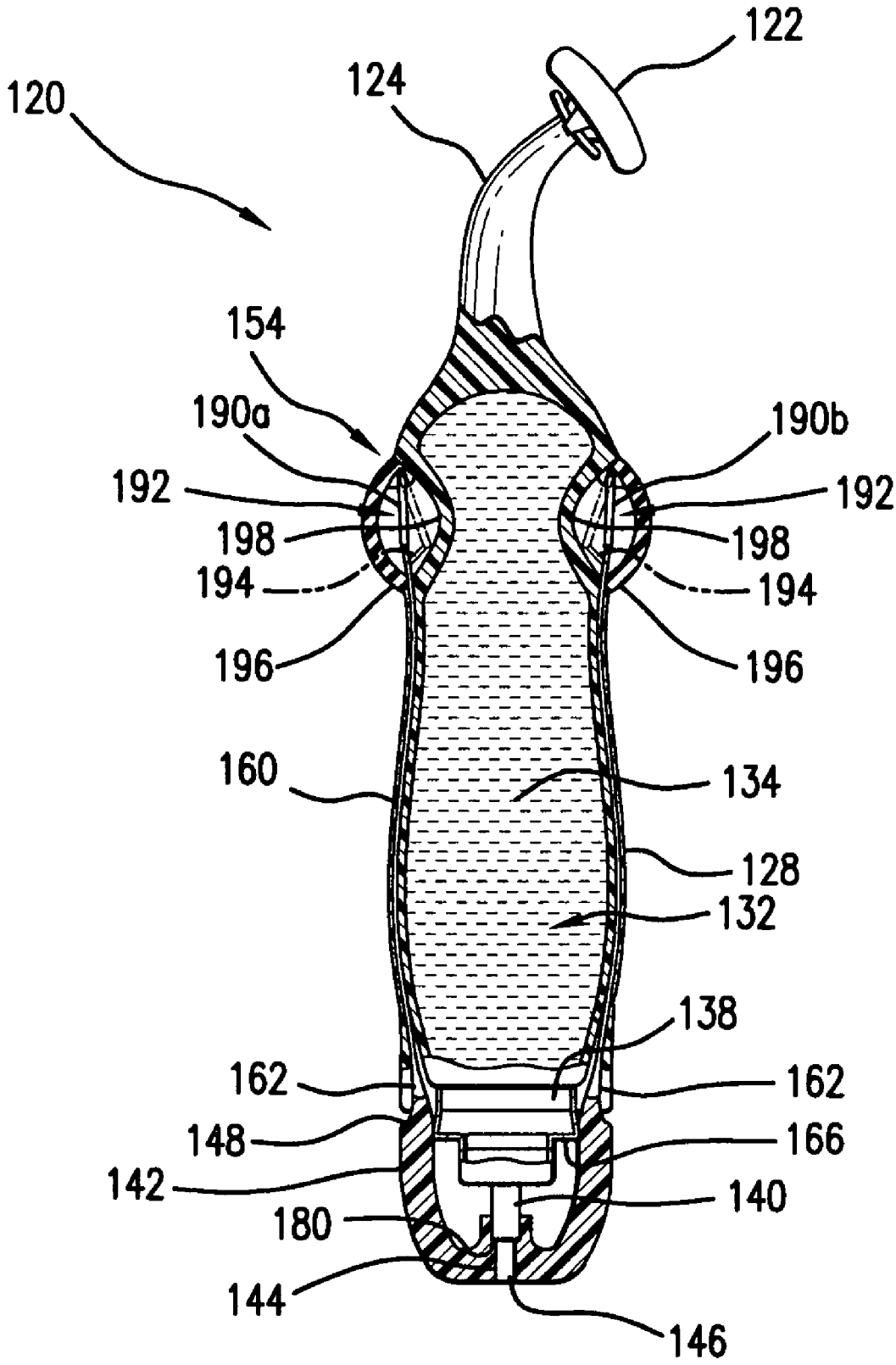
FIG. 5 is an alternate embodiment of the safety razor of FIG. 1 illustrating an alternate finger operated actuator.

Referring now to FIG. 5, a second embodiment of a disposable safety razor 120 is illustrated. Features similar to the features of safety razor 20 as illustrated in FIG. 1 are identified with a like reference number preceded by the number "1". Safety razor 120 has a blade cartridge 122 affixed to neck 124 which is integrally formed with handle 128 extending downwardly therefrom. Handle 128 forms pressure cavity 132. A valve 138 is retained in a bottom portion of handle 128 with crimped metal cap 166. Hollow valve stem 140 extends downwardly from valve 138 and is received in a top portion of dispensing duct 144. Dispensing cap 142 further includes a shoulder 180 that bears against hollow valve stem 140.

Actuator 154 is configured differently than that of safety razor 20. A pivotable arm 190*a* has a top end thereof pivotably affixed to handle 128. A bottom end of pivotable arm 190*a* is affixed to a top end of flexible ribbon 162. A second pivotable arm 190*b* is affixed in like manner to a second flexible ribbon 162, substantially diametrically opposite from the first arm 190*a* and ribbon 162. Each arm can be covered with a flexible membrane 196.

In use, the user presses each membrane 196 in a squeezing like manner. The squeezing motion transitions arms 190*a* and 190*b* from a first position 192, where valve 138 is closed, to a second position 194, wherein arms 190*a*, 190*b* are forced into recesses 198 thereby causing arms 190*a*, 190*b* to pivot. The pivoting motion of arms 190*a*, 190*b* further causes ribbons 162 to translate upwardly and, by reason of their attachment to upper edge 148 of dispenser cap 142, cap 142 is also urged upwardly. The upward force imparted to cap 142 is translated to shoulder 180 which in turn urges valve stem 140 upwardly causing the shaving conditioning compound 134 be dispensed therethrough. When a desired amount of compound 134 is dispensed, the user releases the grip on arms 190*a*, 190*b* allowing them to return to first position 192, thus closing valve 138 and ceasing the dispensing of compound 134.

Figure 6:
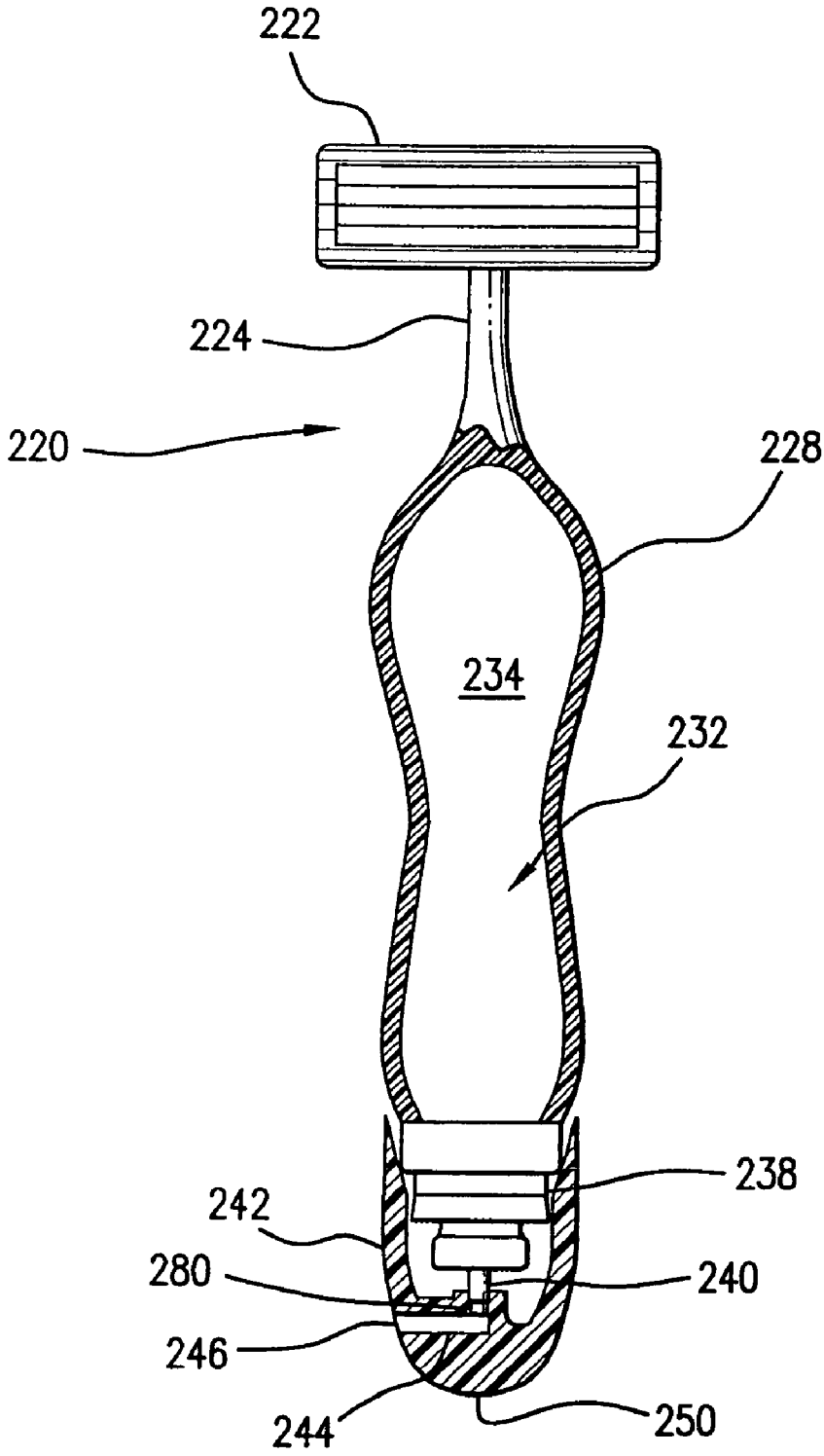
FIG. 6 is an alternate embodiment of the safety razor of FIG. 1 illustrating an alternate actuation mechanism and dispenser port.

Yet another embodiment of a safety razor is illustrated in FIG. 6. Features similar to the features of safety razor 20 as illustrated in FIG. 1 are identified with a like reference number preceded by the number "2". Razor 220 is similarly configured with a blade cartridge 222, neck 224, and ergonomically configured handle 228 that defines a pressure cavity 232 for retaining the shaving conditioning compound 234. A valve 238 is affixed to the bottom of handle 228 to complete the sealing of cavity 232. Valve 238 has a hollow valve stem 240 which is received in an interfering manner in dispensing duct 244. An end of valve stem 240 bears against a shoulder 280 in like manner as shoulder 180 in FIG. 5. Razor 220 does not include a separate actuator or transfer mechanism. Instead, compound 234 is dispensed by placing bottom apex 250 of dispensing cap 242 in the palm of one of the user's hands. The user grasps the handle 228 with the other hand and presses the razor 220 against the palm in which bottom apex 250 rests. This pressing force is translated via shoulder 280 to valve stem 240, thereby vertically displacing valve stem 240 and releasing compound 234 into the user's palm. Once a desired quantity of compound 234 has been dispensed, the pressing action is relieved and valve 238 again closes. The dispensing cap 242 may be structured to include a locking mechanism to prevent accidental dispensing of the shaving conditioning compound between use.

The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent law, including the doctrine of equivalents.

I claim:

1. A disposable safety razor having an integral shaving conditioner dispenser, said disposable safety razor when in an upright orientation comprising:

a neck, a blade cartridge affixed to a top end of said neck;

a handle affixed to and extending from a bottom end of said neck, said handle having an exterior wall defining a pressure cavity therein for receiving a shaving conditioning compound and a pressurized dispensing gas, and further defining an opening at a bottom thereof:

a valve received in said opening and said valve being operable between a closed position and an open position, and said valve being structured and disposed to contain the shaving conditioning compound within said pressure cavity when in said closed position and to release the shaving conditioning compound downwardly through said valve when in said open position;

a dispensing cap covering said valve and engaged therewith such that movement of said dispensing cap towards said handle urges said valve to said open position to cause release of the shaving conditioning compound through said valve;

a moveable actuator on said handle and being movable relative to said handle between a first position and a second position; and a transfer mechanism operatively linked between said actuator and said dispensing cap and being structured and disposed for moving said dispensing cap towards said handle when said actuator is moved from said first position to said second position to thereby operate said valve to said open position and cause release of the shaving conditioning compound outwardly through said valve.

2. The disposable safety razor according to claim 1 wherein said valve includes a normally closed hollow valve stem extending at least partially through said valve and further wherein physical displacement of said valve stem causes said valve stem to become open and to permit fluid communication between said pressure cavity and an exterior of said valve.

3. The disposable safety razor according to claim 2 wherein said dispensing cap defines a dispensing duct therethrough and wherein said dispensing duct is sleeved over at least a portion of said valve stem such that physical displacement of said dispensing cap causes a like displacement of said valve stem.

4. The disposable safety razor according to claim 3 wherein said dispensing duct terminates at a dispensing port at an exterior surface of said dispensing cap.

5. The disposable safety razor according to claim 4 wherein said dispensing port is positioned at a bottom apex of said dispensing cap.

6. The disposable safety razor according to claim 4 wherein said dispensing port is positioned substantially at a radial side of said dispensing cap.

7. The disposable safety razor according to claim 1 wherein said transfer mechanism comprises a flexible ribbon slidably housed in a channel defined in said exterior wall, a first end of said ribbon affixed to said actuator and a second end of said ribbon affixed to said dispensing cap.

8. The disposable safety razor according to claim 1 wherein said actuator includes at least one pivotable lever affixed to said transfer mechanism, said lever pivotable between a first position for unblocking said valve stem to allow release of the shaving conditioning compound through said valve and a second position for fluidically sealing said pressure cavity from said exterior of said valve.

9. The disposable safety razor according to claim 8 comprising a second pivotable lever positioned diametrically opposite from said at least one pivotable lever, and further comprising a second transfer mechanism extending between said second pivotable lever and said dispensing cap.

10. The disposable safety razor according to claim 8 wherein said pivotable lever is covered by a flexible membrane.

11. The disposable safety razor according to claim 1 wherein said valve is retained in said opening in said handle with a crimped metal cap.

12. The disposable safety razor according to claim 1 wherein said handle is ergonomically shaped to fit the inner contour of a human hand.

13. A disposable safety razor having an integral shaving conditioner dispenser, said disposable safety razor when in an upright orientation comprising:

a neck;

a blade cartridge affixed to a top end of said neck;

a handle ergonomically shaped to fit the inner contour of a human hand and affixed to and extending from a bottom end of said neck, said handle having an exterior wall defining a pressure cavity therein for receiving a shaving conditioning compound and a pressurized dispensing gas, and further defining an opening at a bottom thereof;

a valve received in said opening and said valve being operable between a closed position to maintain the shaving conditioning compound within said pressure cavity and an open position to allow release of the shaving conditioning compound downwardly through said valve;

a dispensing cap covering said valve and engaged therewith such that movement of said dispensing cap operates said valve to said open position to cause release of the shaving conditioning compound through said valve;

an actuator on a side of said handle and being movable relative to said handle; and a transfer mechanism interconnecting said actuator with said dispensing cap for moving said dispensing cap towards the handle to operate said valve between said open and closed positions by moving said actuator.

14. The disposable safety razor according to claim 13 wherein said actuator includes a slidable button interconnected with said transfer mechanism, said slidable button repositionable between a first position for operating said valve to said open position to allow release of the shaving conditioning compound through said valve and a second position for maintaining said valve in said closed position and fluidically sealing said pressure cavity from an exterior of said valve.

15. The disposable safety razor according to claim 13 wherein said actuator includes at least one pivotable lever affixed to said transfer mechanism, said lever pivotable between a first position for operating said valve to allow release of the shaving conditioning compound through said valve and a second position for fluidically sealing said pressure cavity from an exterior of said valve.

16. The disposable safety razor according to claim 13 wherein said transfer mechanism comprises a flexible ribbon slidably housed in a channel defined in said exterior wall, a first end of said ribbon affixed to said actuator and a second end of said ribbon affixed to said dispensing cap.

* * * * *